United States Patent [19]

Ritchie et al.

[11] 4,426,123

[45] Jan. 17, 1984

[54] CAM ACTUATED ZERO INSERTION CONNECTOR ASSEMBLY

[75] Inventors: Leon T. Ritchie, Mechanicsburg; Clair W. Snyder, Jr., York; John A. Woratyla, Camp Hill, all of Pa.

[73] Assignee: AMP Incorporated, Harrisburg, Pa.

[21] Appl. No.: 240,525

[22] Filed: Mar. 9, 1981

[51] Int. Cl.[3] ..... H01R 13/62

[52] U.S. Cl. ..... 339/75 MP; 339/176 M

[58] Field of Search ..... 339/17 C, 176 M, 75 R, 339/75 M, 75 MP

[56] References Cited

U.S. PATENT DOCUMENTS

| | | | |
|---|---|---|---|
| 3,315,212 | 4/1967 | Peterson | 339/176 M |
| 3,763,459 | 10/1973 | Millis | 339/75 M |
| 3,848,222 | 11/1974 | Lightner | 339/75 M |
| 4,217,020 | 8/1980 | Holland | 339/17 C |
| 4,243,288 | 1/1981 | Lucius et al. | 339/99 R |

FOREIGN PATENT DOCUMENTS

| | | | |
|---|---|---|---|
| 4422 | 10/1979 | European Pat. Off. | 339/176 M |
| 3008841 | 9/1980 | Fed. Rep. of Germany | 339/75 M |

OTHER PUBLICATIONS

IBM Technical Disclosure Bulletin vol. 15, No. 7 12/1972, "Positive Actuation Tool for Electrical Contact System".

*Primary Examiner*—John McQuade
*Attorney, Agent, or Firm*—Russell J. Egan

[57] ABSTRACT

A connector assembly is disclosed for effecting zero insertion force mating of projecting blade portions of terminals carried by a plug member with conductive holes in a circuit board or the like and enclosed in a header. The plug member has a housing, a plurality of terminals carried in the housing each with a blade portion projecting from a mating face and a conductor engaging portion, and hermaphroditic cover members enclosing a portion of the housing. The housing also has a cam surface and polarizing lugs. The header has means to mount it on a circuit board or the like with walls of the header forming a shroud around an array of conductive holes in the circuit board. A cam member is rotatably mounted in one end of the header to act on the plug member driving it transversely to bring the blades of the terminals into contact with the walls of the respective conductive holes.

6 Claims, 4 Drawing Figures

CAM ACTUATED ZERO INSERTION CONNECTOR ASSEMBLY

BACKGROUND OF THE INVENTION

1. The Field Of The Invention

The present invention relates to a connector assembly and in particular to an assembly which provides zero insertion force for mating terminals having projecting resilient beams with conductive holes in a circuit board or the like.

2. The Prior Art

Most of the well known electrical connectors require a certain amount of force to accomplish insertion and extraction of the movable contact elements. This force is usually dependent upon the number of contacts being mated as well as the type of contacts. A drawback of high insertion force is not only is there the requirement of overcoming the force itself, but there is undue wear that is accompanied by the high force of the wiping action. Undue wear of this nature is particularly of concern where at least one of the contacting surfaces is plated. Undue wear would, of course, wear through the plating causing either a breakdown in the surface entirely or an open circuit condition.

Various attempts have been made to provide zero insertion mating as evidenced, for example, by U.S. Pat. No. 3,848,222 and others. However, this patent does not concern itself with the particular problem of effecting zero insertion force mating of a plug member with conductive holes in a circuit board or the like.

SUMMARY OF THE INVENTION

The present invention is intended to provide a zero or low insertion force connector assembly which can both be mass terminated and used to mate with conductive holes in a circuit board or the like. The plug member of the subject connector assembly has a housing with a plurality of terminal passages extending therethrough from an outwardly open rear end to an enclosed mating face. A like plurality of terminals are each inserted in a respective passage with a beam portion of each terminal projecting from the mating face of the housing and an insulation displacing conductor engaging portion lying in an open rear portion of each passage. The plug member is completed by a pair of hermaphroditic cover members enclosing the rear portion of the housing. A header has means for securing it to a circuit board with walls of the header forming a shroud enclosing an array of conductive holes in the circuit board. A cam is rotatably mounted at one end of the header to act upon one end of the plug member to drive it transversely of the header bringing the beams of the terminals into engagement with the walls of the respective conductive holes.

It is therefore an object of the present invention to produce an improved electrical connector assembly which will provide zero insertion mating of a plug member with plated-through holes of a circuit board or the like.

It is another object of the present invention to produce an improved electrical connector which can be mass terminated and provide for low insertion mating with conductive holes in a circuit board or the like.

It is a further object of the present invention to produce an electrical connector assembly which is mated in a first condition with blades of terminals carried by a plug member extending into but only incidentally contacting walls of conductive holes and then the plug member is driven transversely with respect to the holes to bring the blades into resilient engagement with the holes.

It is a further object of the present invention to provide an improved electrical connector assembly which can be readily and economically manufactured and mass terminated.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
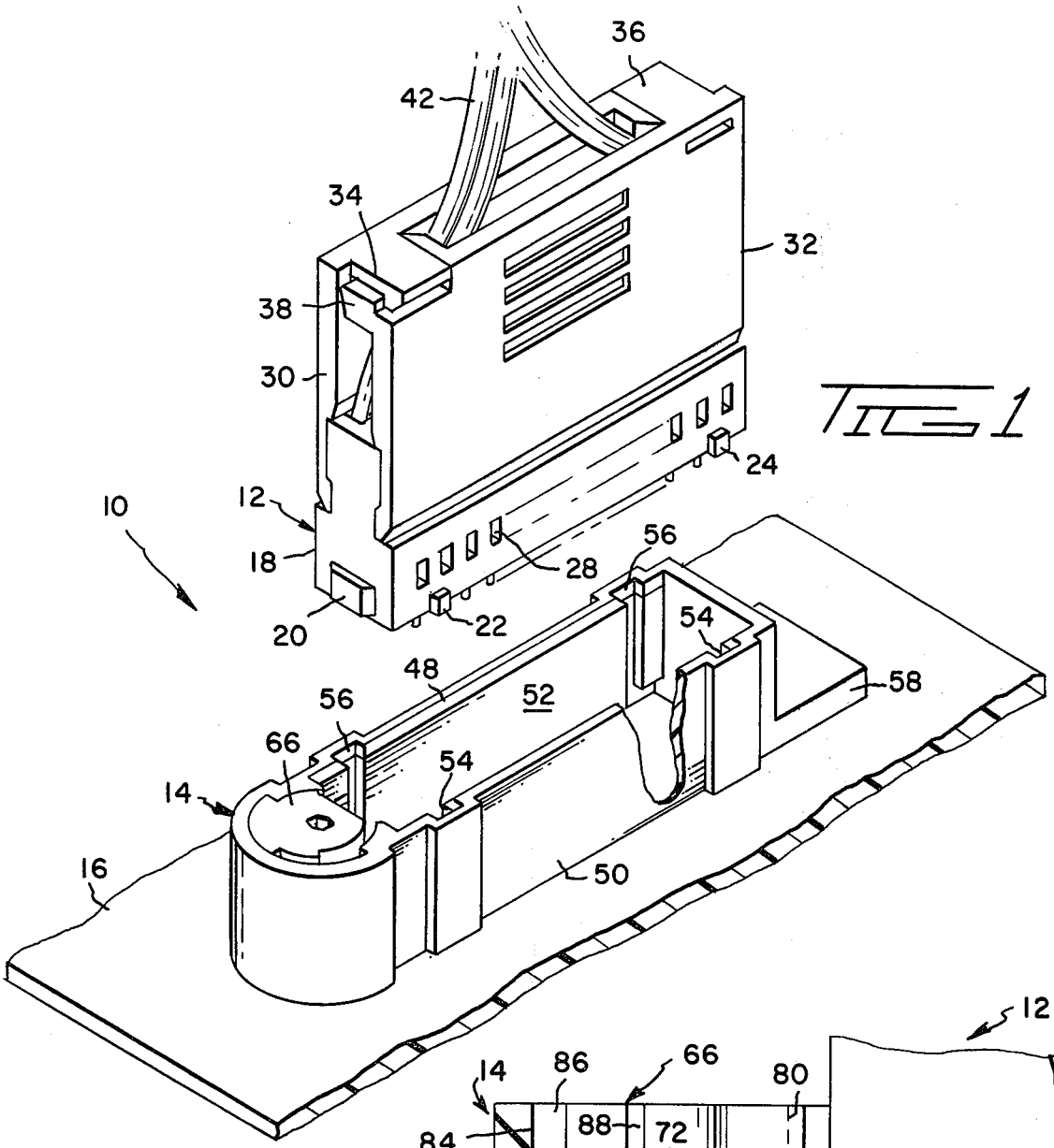
FIG. 1 is an exploded perspective view of the electrical connector according to the present invention.

The subject connector assembly 10 has a plug assembly 12 and a header assembly 14 which is mounted on a circuit board 16. The plug assembly 12 includes a housing 18 which is quite similar to the housing 12 disclosed in U.S. Pat. No. 4,243,288, the disclosure of which is incorporated herein by reference. The primary difference between the present housing 18 and that of the patent is the present housing includes a cam abutment 20 on one end and at least one polarizing lug 22, 24 extending laterally from a side surface. The housing 18 has a plurality of passages 26 and a like plurality of transverse apertures 28, each opening into a respective passage. The plug assembly 12 also has a pair of mating hermaphroditic cover members 30, 32 each with a locking leg 34, 36 adapted to engage a shoulder 38 on the oposite cover member. A plurality of terminals 40 are carried by the plug member. Each terminal is similar to that described in U.S. patent application Ser. No. 927,720, filed July 25, 1978 now abandoned, the disclosure of which is incorporated herein by reference, in that they have a rear portion (not shown) which provides mass insulation displacing termination capability for conductors 42. The terminals 40 also include locking lances 44 and projecting resilient cantilever beams 46.

Figure 4:
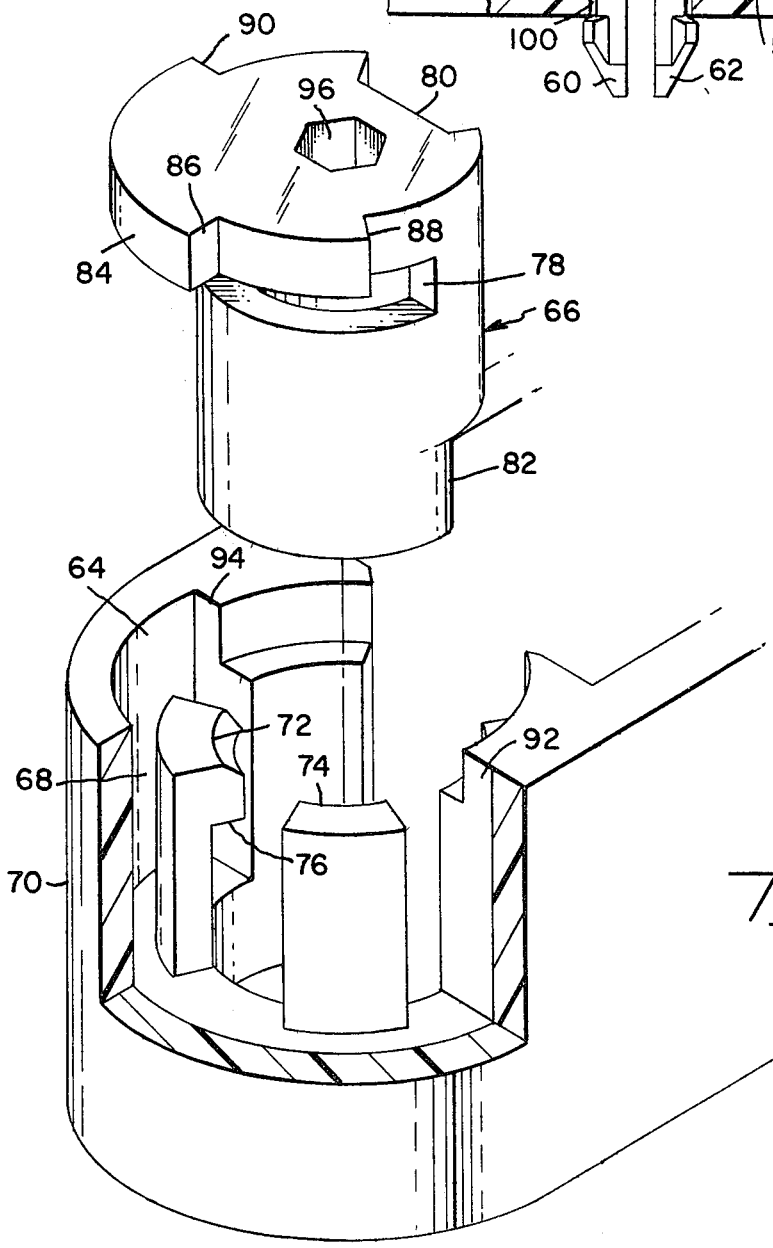
FIG. 4 is a perspective view of one end of the header member of the subject connector assembly with the cam exploded therefrom.

The header assembly 14 is an elongated member of rigid insulative material having a pair of spaced sidewalls 48, 50 defining a plug receiving cavity 52 therebetween. Each sidewall is provided with at least one polarizing slot 54, 56. The base 58 of the header includes downwardly projecting, bifurcated, mounting legs 60, 62. A cam receptacle 64 (see FIG. 4) is formed at one end of the header assembly and receives a substantially cylindrical cam 66 therein. The cam receptacle is generally circular forming an arcuate slot 68 between curved outer wall 70 and a pair of arcuate lugs 72, 74 each having an inwardly directed lip 76. The cam 66 has an arcuate groove 78 which receives the lips 76 of the lugs 72, 74. The cam 66 also has a groove 80 extending parallel to and spaced from the axis of the cam and which allows passage of the cam abutment 20 during mating of the plug assembly 12 into the header assembly 14. The cam 66 also has a driving surface 82 which, upon rotation of the cam, makes engagement with the cam abutment 20. The cam 66 further has a planar profiled flange 84 with steps 86, 88, 90 which engage walls 92, 94 of the receptacle 64 to limit the rotary movement of the cam. The cam further has an axial driving aperture 96, which has been shown as a hexagonal recess receiving a common hex wrench to rotatably drive the cam. Clearly this aperture 96 could be of any shape and could have a driving lever (not shown) associated therewith, either as a separable member or as an integrated portion.

The circuit board 16 includes a plurality of conductive holes 98 in a spaced array as well as mounting apertures 100 located at opposite ends of the array of conductive holes. The holes 98 can either be plated-through holes integral with circuitry on the circuit board, or lined with a grommet or the like making mechanical contact with the circuitry.

Figure 2:
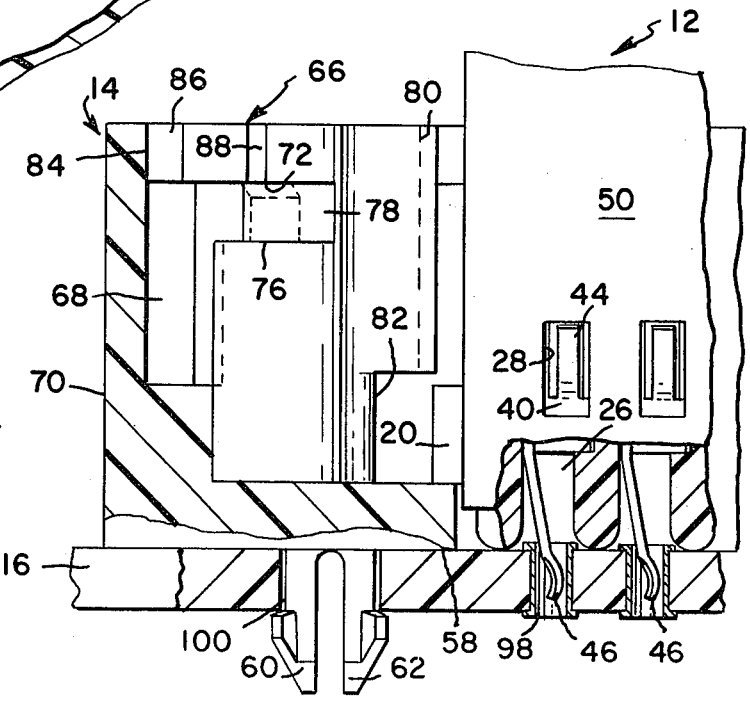
FIG. 2 is a fragmentary side elevation, partly in section, showing one end of the subject connector assembly in a mated but non-contacting condition.
Figure 3:
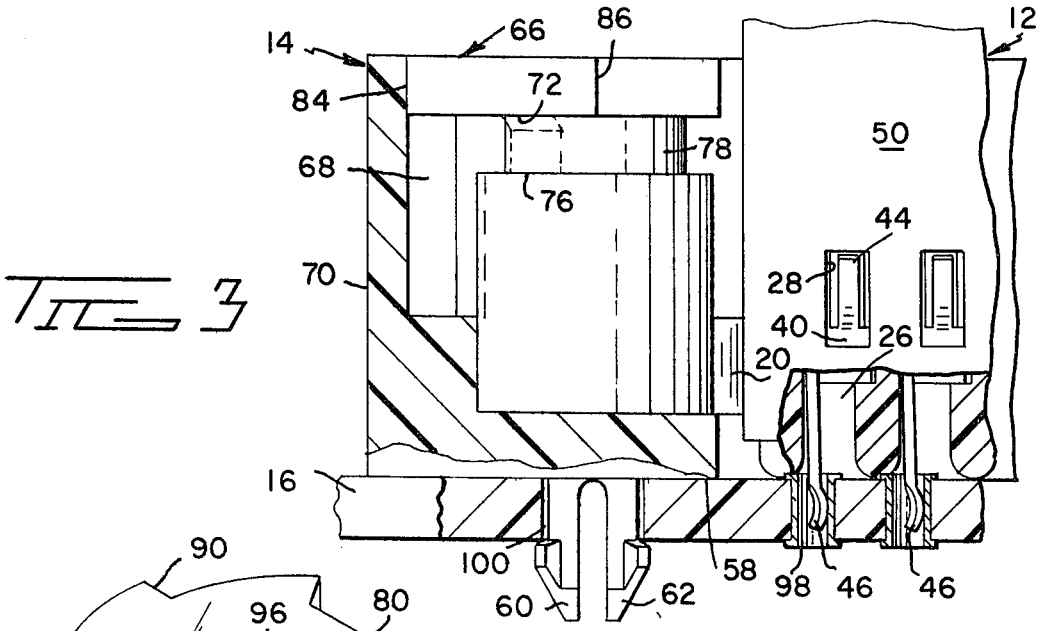
FIG. 3 is a fragmentary side elevation, partly in section, similar to FIG. 2 showing one end of the subject connector assembly in a mated and fully contacting condition.

The plug assembly 12 of the subject connector is assembled in the manner described in the previously mentioned U.S. Pat. No. 4,243,288 and the conductors 42 connected thereto. The terminated plug assembly is mated with the header assembly by simply inserting the former so that the polarizing lugs 22, 24 slide down in the grooves 54, 56. The cam must be positioned so that the abutment 20 can slide down through the slot 80. When the plug assembly is fully inserted into the header assembly, the beams 46 of the plug assembly will lie within the conductive holes 98 and only be in incidental contact therewith, as shown in FIG. 2. Upon rotation of the cam 66 the plug assembly 12 will be driven transversely of the header assembly 14, to the right in the Figures, so that the beams 46 are brought into contact with the conductive walls of the holes 98, as shown in FIG. 3. The procedure is simply reversed for unmating of the plug assembly.

The present invention may be subject to many modifications and changes without departing from the spirit or essential characteristics thereof. The present embodiment is therefore to be considered in all respects as illustrative and not restrictive of the scope of the invention.

What is claimed is:

1. A low entry force electrical connector system for making interconnection with an array of conductive holes of a circuit board or the like, comprising:

a plug assembly having a housing with a mating face and a plurality of terminals mounted in said housing each with a beam portion extending beyond said mating face;

a header assembly having means to mount said header assembly on a circuit board and spaced walls defining a plug receiving cavity enclosing an array of conductive holes in said circuit board, cam means mounted in one end of said header assembly adapted to act on said plug assembly whereby when said plug assembly is initially engaged in said header assembly said beam portions extend at least partially into each respective conductive hole in said circuit board and upon actuation of said cam means said plug assembly is driven transversely with respect to said header assembly to bring said beam portions into engagement with walls of the respective conductive holes.

2. The electrical connector system according to claim 1 further comprising:

polarizing means on said plug assembly and said header assembly permitting only a unidirectional mating of said plug assembly and said header assembly.

3. The electrical connector system according to claim 1 further comprising:

cam abutment means on one end of said plug assembly which abutment is engaged by said cam means to drive said plug assembly transversely.

4. The electrical connector system according to claim 1 further comprising:

mounting legs depending from said header assembly and engagable in mounting apertures in said circuit board adjacent said array of conductive holes to securely mount said header assembly on said circuit board.

5. The electrical connector system according to claim 1 wherein said cam means comprises:

a first driving surface acting against said plug assembly, and a second profiled flange portion guided by said header assembly to limit the rotary movement of said cam.

6. An electrical connector system according to claim 1 wherein said header assembly further comprises:

a cam receptacle having an arcuate wall and a pair of lugs spaced inwardly of said arcuate wall defining an arcuate slot therebetween, an annular recess in said cam means, an inwardly directed shoulder on a free end of each said lug engageable in said annular recess whereby movement of said cam means is limited to rotary only.

* * * * *